US009254409B2

(12) United States Patent
Dalebout et al.

(10) Patent No.: US 9,254,409 B2
(45) Date of Patent: Feb. 9, 2016

(54) STRENGTH TRAINING APPARATUS WITH FLYWHEEL AND RELATED METHODS

(71) Applicant: ICON Health & Fitness, Inc., Logan, UT (US)

(72) Inventors: William Dalebout, North Logan, UT (US); Michael Olson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 49 days.

(21) Appl. No.: 14/213,793

(22) Filed: Mar. 14, 2014

(65) Prior Publication Data

US 2014/0274600 A1 Sep. 18, 2014

Related U.S. Application Data

(60) Provisional application No. 61/786,007, filed on Mar. 14, 2013.

(51) Int. Cl.

| | |
|---|---|
| ***A63B 21/00*** | (2006.01) |
| ***A63B 21/22*** | (2006.01) |
| ***A63B 21/005*** | (2006.01) |
| ***A63B 21/04*** | (2006.01) |
| ***A63B 23/035*** | (2006.01) |

(Continued)

(52) U.S. Cl.

CPC ..... *A63B 21/225* (2013.01); *A63B 21/0052* (2013.01); *A63B 21/00076* (2013.01); *A63B 21/0442* (2013.01); *A63B 21/154* (2013.01); *A63B 21/156* (2013.01); *A63B 21/4035* (2015.10); *A63B 21/4043* (2015.10); *A63B 21/4049* (2015.10); *A63B 23/03533* (2013.01); *A63B 23/03541* (2013.01); *A63B 23/1209* (2013.01); *A63B 23/1218* (2013.01); *A63B 23/1227* (2013.01); *A63B 2024/0065* (2013.01); *A63B 2024/0093* (2013.01); *A63B 2071/0625* (2013.01); *A63B 2071/0675* (2013.01); *A63B 2071/0694* (2013.01); *A63B 2220/54* (2013.01); *A63B 2220/833* (2013.01); *A63B 2225/09* (2013.01)

(58) Field of Classification Search

CPC ..... A63B 21/00
USPC ..... 482/52, 8, 57, 63
See application file for complete search history.

(56) References Cited

U.S. PATENT DOCUMENTS

| | | | |
|---|---|---|---|
| 5,527,245 | A | 6/1996 | Dalebout et al. |
| 6,746,371 | B1 | 6/2004 | Brown |

(Continued)

OTHER PUBLICATIONS

PCT International Search Report for PCT International Patent Application No. PCT/US2014/029353, mailed Aug. 4, 2014.

*Primary Examiner* — Jerome W Donnelly
(74) *Attorney, Agent, or Firm* — Holland & Hart LLP

(57) ABSTRACT

Embodiments of a strength training apparatus and related methods are provided. In one embodiment, the strength training apparatus includes a base member and a tower structure coupled with the base member. At least one arm is pivotally coupled with the tower structure. A flywheel and a cable and pulley system are associated with the at least one arm, wherein displacement of at least one cable of the cable and pulley system effects rotation of the flywheel. The strength training apparatus may include a selectively adjustable magnetic braking mechanism associated with a flywheel that is configured to apply a selected resistance to the rotation of the flywheel. A torque sensor may be associated with the flywheel and the measured torque during operation of the apparatus may be used to calculate the work expended in rotating the flywheel. In one embodiment, the calculated work may be expressed in units of watts.

18 Claims, 7 Drawing Sheets

(51) Int. Cl.

| | |
|---|---|
| ***A63B 23/12*** | (2006.01) |
| *A63B 24/00* | (2006.01) |
| *A63B 71/06* | (2006.01) |

(56) References Cited

U.S. PATENT DOCUMENTS

| | | | | |
|---|---|---|---|---|
| 6,857,993 | B2 | 2/2005 | Yeh | |
| 7,011,326 | B1 | 3/2006 | Schroeder et al. | |
| 7,364,538 | B2 | 4/2008 | Aucamp | |
| 7,584,673 | B2 | 9/2009 | Shimizu | |
| 7,740,563 | B2 | 6/2010 | Dalebout et al. | |
| 2005/0049117 | A1* | 3/2005 | Rodgers, Jr. | 482/52 |
| 2005/0164837 | A1* | 7/2005 | Anderson et al. | 482/52 |
| 2007/0197346 | A1* | 8/2007 | Seliber | 482/57 |
| 2012/0088638 | A1 | 4/2012 | Lull | |
| 2013/0196821 | A1 | 8/2013 | Watterson et al. | |

* cited by examiner

STRENGTH TRAINING APPARATUS WITH FLYWHEEL AND RELATED METHODS

CROSS-REFERENCE TO RELATED APPLICATIONS

This application claims priority to U.S. Provisional Patent application 61/786,007 filed on Mar. 14, 2013.

TECHNICAL FIELD

The present disclosure relates to exercise equipment. More particularly, the present disclosure relates to strength training equipment including a flywheel and to related methods.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups or a series of short sprints.

When exercising at home or in a gym, aerobic and anaerobic exercise usually involves the use of different types of equipment. For example, aerobic exercise usually involves equipment such as treadmills, ellipticals and bicycles (traditional and stationary) while anaerobic exercise often involves the use of free weights, weight stacks, or other cable and pulley resistance-type systems.

Often, individuals will plan their work-out routines to include both aerobic and anaerobic activities. For example, a person may do anaerobic exercises (e.g., weight lifting and other strength training exercises) on two or three days of the week while doing aerobic exercising (e.g., running, bicycling) on the remaining days of the week. In other instances, an individual may do both aerobic and anaerobic activities during the same day.

One of the difficulties in integrating both aerobic and anaerobic activities is the ability of an individual to efficiently and effectively track their progress. For example, many individuals use aerobic exercise equipment such as a treadmill or an elliptical machine to automatically track the calories that they've burned while using such equipment. However, it is more difficult to track or calculate such information when doing strength training exercises.

A couple of examples of equipment that has tried to combine aerobic exercising with anaerobic exercising are described in U.S. Pat. No. 5,527,245 to Dalebout et al. and U.S. Pat. No. 7,740,563 to Dalebout et al. These patents describe a resistance-type strength training apparatus combined with, in one instance, a treadmill, and in another instance an elliptical device.

In view of the foregoing, it would be desirable to provide the ability to track one's progress during exercise in a manner that is applicable to both aerobic and anaerobic activities and which is simple and effective. Additionally, it is a general desire in the industry to provide exercise equipment with new features and enhanced performance.

SUMMARY

In one aspect of the disclosure, a strength training apparatus includes a base member and a tower structure coupled with the base member.

In one or more other aspects that may be combined with any of the aspects herein, may further include at least one arm that is pivotally coupled with the tower structure.

In one or more other aspects that may be combined with any of the aspects herein, may further include a flywheel and a cable and pulley system associated with the at least one arm, wherein displacement of at least one cable of the cable and pulley system effects rotation of the flywheel.

In one or more other aspects that may be combined with any of the aspects herein, may further include a braking mechanism associated with a flywheel and configured to apply a selected resistance to the rotation of the flywheel.

In one or more other aspects that may be combined with any of the aspects herein, may further include a braking mechanism including a magnetic braking mechanism.

In one or more other aspects that may be combined with any of the aspects herein, may further include a torque sensor associated with the flywheel.

In one or more other aspects that may be combined with any of the aspects herein, may further include a console having at least one input device and at least one output device.

In one or more other aspects that may be combined with any of the aspects herein, may further include the console in communication with the braking mechanism, wherein the at least one input device controls the amount of resistance applied to the flywheel by the braking mechanism.

In one or more other aspects that may be combined with any of the aspects herein, may further include the console in communication with the torque sensor, wherein the at least one output device provides an indication of the amount of work expended by a user upon rotation of the flywheel.

In one or more other aspects that may be combined with any of the aspects herein, may further include the at least one output device provides the indication of the amount of work expended in units of watts.

In one or more other aspects that may be combined with any of the aspects herein, may further include the strength training apparatus includes a drive mechanism associated with the flywheel.

In one or more other aspects that may be combined with any of the aspects herein, may further include a clutch mechanism coupled with the flywheel by way of a drive belt.

In one or more other aspects that may be combined with any of the aspects herein, may further include the clutch mechanism enabling the rotation of the flywheel in a first rotational direction upon the displacement of the at least one cable in a first defined direction, but has no effect on the flywheel upon displacement of the at least one cable in a second defined direction, the second defined direction being the opposite of the first defined direction.

In one or more other aspects that may be combined with any of the aspects herein, may further include the drive mechanism having a drive chain coupled with the cable and pulley system, wherein the drive chain extends about a plurality of sprockets including at least one sprocket that is displaceable relative to the tower.

In one or more other aspects that may be combined with any of the aspects herein, may further include at least one biasing member coupled with the at least one displaceable sprocket.

In one or more other aspects that may be combined with any of the aspects herein, may further include an embodiment where the at least one arm includes a pair of arms, wherein the cable and pulley system includes a first pulley coupled with a first arm of the pair of arms with a first cable extending through the first pulley and a second pulley coupled with the second arm with a second cable extending through the second pulley.

In one or more other aspects that may be combined with any of the aspects herein, may further include the pair of arms maintained in a fixed angular position relative to each other.

In another aspect of the disclosure, a method of conducting strength training includes applying a force to a cable and displacing the cable in a first direction and effecting rotation of a flywheel upon displacement of the cable.

In one or more other aspects that may be combined with any of the aspects herein, may further include a resistance applied to the flywheel and the torque applied to the flywheel being measured, such as by way of a sensor.

In one or more other aspects that may be combined with any of the aspects herein, may further include calculating the work performed, in watts, based at least in part on the measured torque.

In one or more other aspects that may be combined with any of the aspects herein, may further include applying resistance to the flywheel by applying resistance using a magnetic brake.

In one or more other aspects that may be combined with any of the aspects herein, may further include the resistance applied by the magnetic brake being selectively varied.

In one or more other aspects that may be combined with any of the aspects herein, may further include applying a force to a cable including pulling the cable through a pulley, and selectively positioning the pulley at one of a variety of positions prior to pulling the cable through the pulley.

In one or more other aspects that may be combined with any of the aspects herein, may further include a method of tracking work expended during exercising including conducting an aerobic exercise activity and determining the work expended during the aerobic exercise activity and expressing the work expended in units of watts.

In one or more other aspects that may be combined with any of the aspects herein, may further include and embodiment where an anaerobic exercise activity is conducted and the work expended during the anaerobic exercise activity is determined and expressed in units of watts.

In one or more other aspects that may be combined with any of the aspects herein, may further include summing the amount of work expended during the aerobic activity and the amount of work expended during the anaerobic activity.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
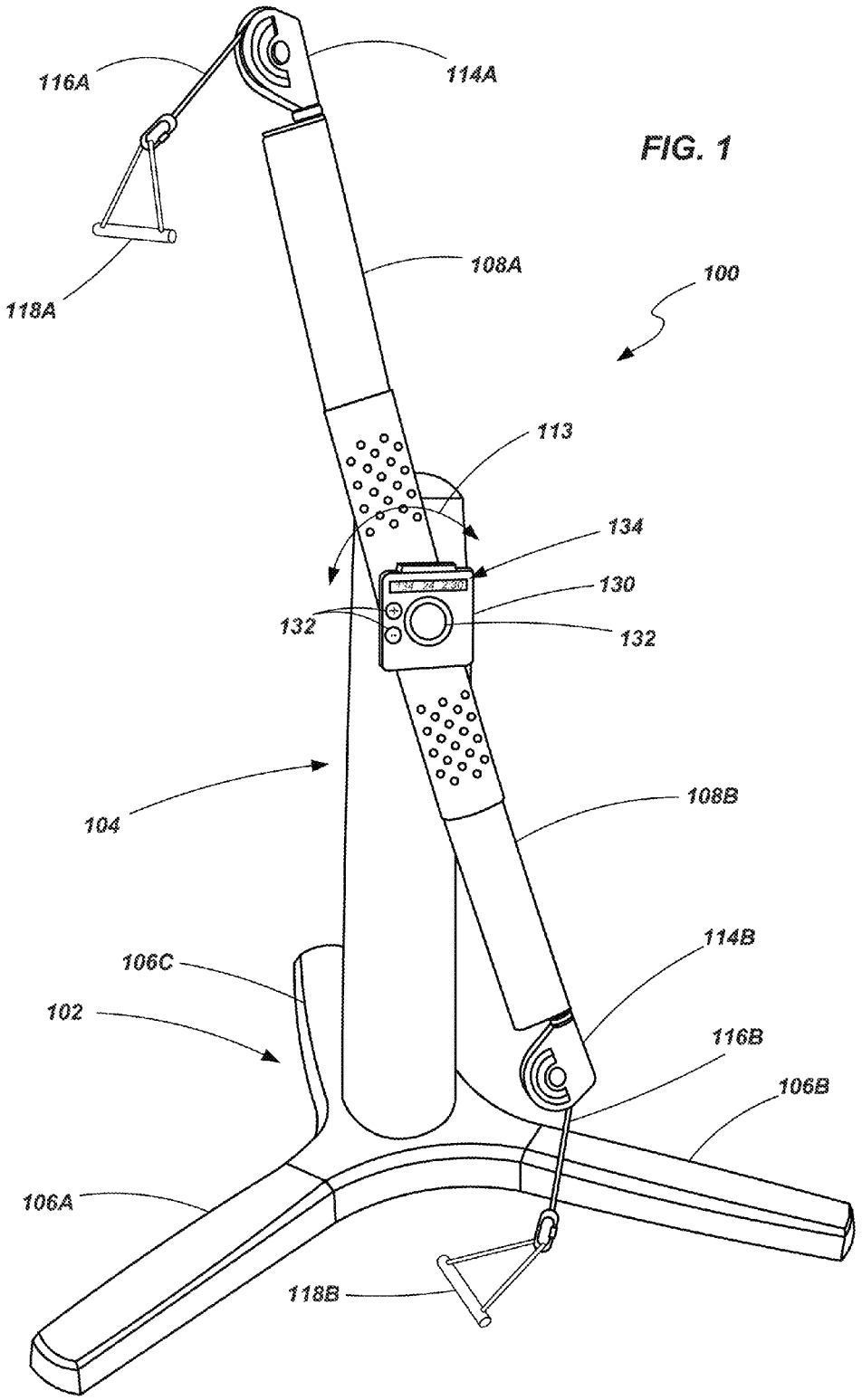
FIG. 1 is a perspective view of a strength training apparatus.
Figure 2:
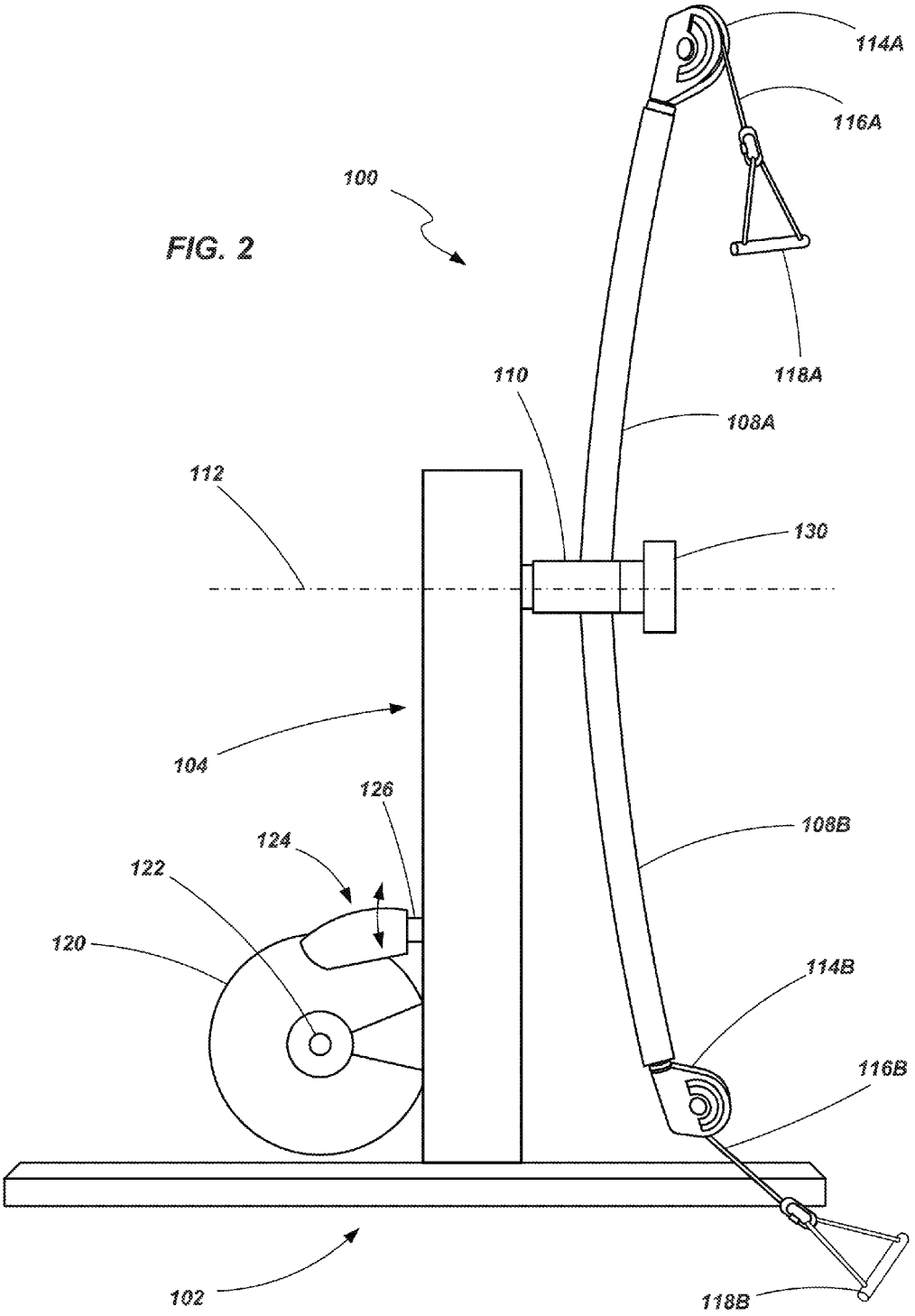
FIG. 2 is a first side view of the strength training apparatus shown in FIG. 1.
Figure 3:
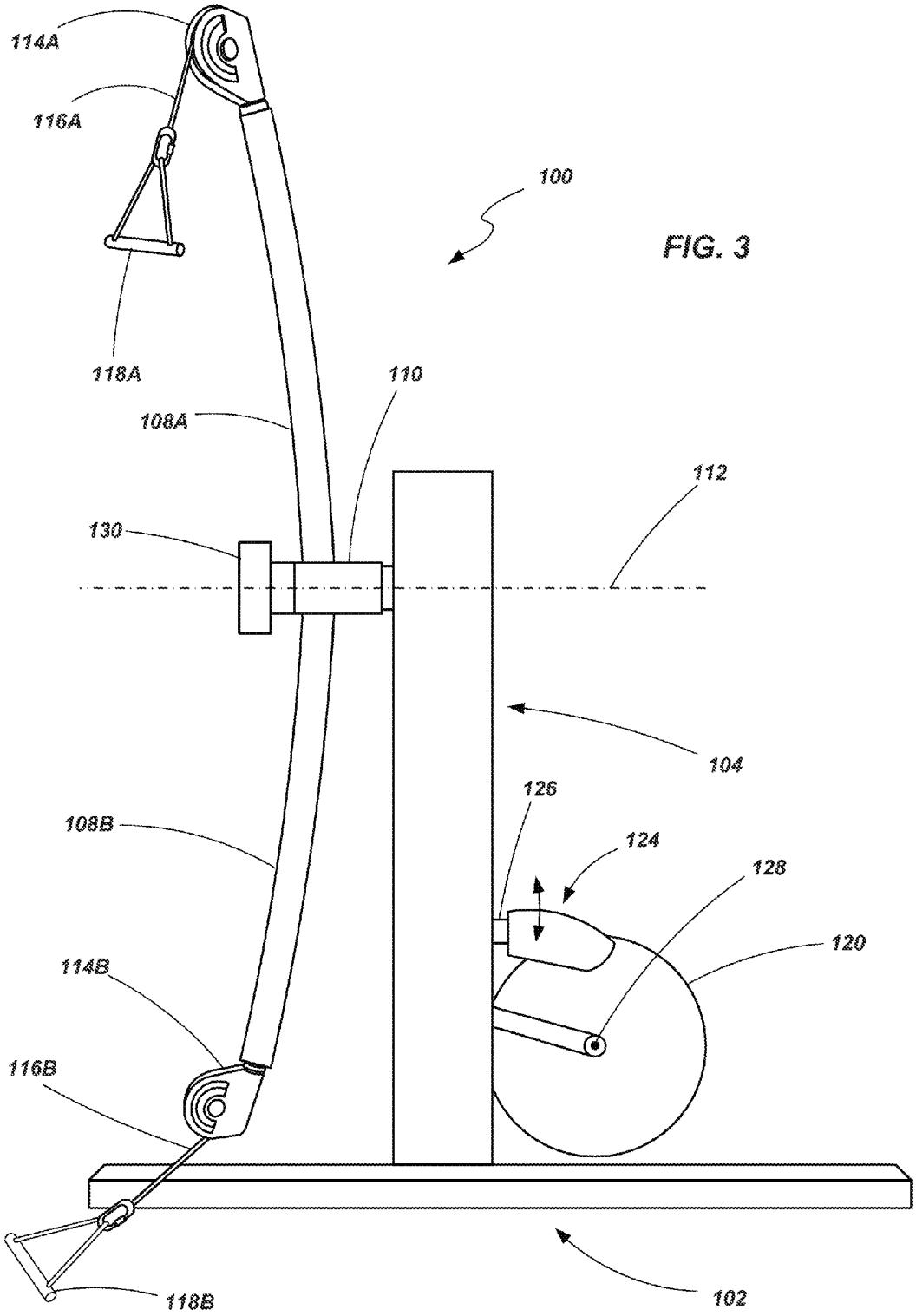
FIG. 3 is another side view of the strength training apparatus shown in FIG. 1.

Referring to FIGS. 1-3, a strength training apparatus 100 is provided. The apparatus 100, according to certain embodiments, includes a base member 102 and a tower or support structure 104 coupled to, and extending upward from, the base member 102. The base may be configured to include a plurality of legs 106A-106C extending away from each other to provide a stable base or platform for the apparatus 100 and to support the apparatus 100 when forces are applied to it by someone using the apparatus 100 to exercise. In the embodiment shown in FIGS. 1-3, the base member 102 includes three legs. However, it is noted that other configurations are contemplated.

A pair of arms 108A and 108B are pivotally coupled to the tower 104 by way of a bearing 110 or other mechanical structure. The bearing 110 enables the arms 108A and 108B to rotate about a defined axis 113 (FIGS. 2 and 3) relative to the tower 104 and base member 102 as indicated by directional arrow 112 (FIG. 1). In one embodiment, the arms 108A and 108B may be configured to maintain a constant angular relationship relative to each other as they are rotated about the axis 112 (e.g., they may continually extend in substantially opposite directions from each other). In another embodiment, each arm 108A and 108B may be selectively positionable (manually, or by a motor or other actuator (not shown)) independent of the other so that they may be positioned at any of a variety of angles relative to each other.

The apparatus 100 also includes a pair of pulleys 114A and 114B, one being pivotally coupled to the end of each arm 106A and 106B. Cables 116A and 116B extend through each pulley 114A and 114B and are coupled with handles 118A and 118B. As will be described in further detail below, the handles 118A and 118B, the cables 116A and 116B and the pulleys 114A and 114B are part of a cable/pulley system that provides resistance to an individual that is using the apparatus 100 for strength training.

As seen in FIGS. 2 and 3, a flywheel 120 is coupled to either the base member 102 or the tower 104 (or to both) and configured to rotate about a shaft 122. A resistance or braking mechanism 124 is positioned adjacent the flywheel 122 and is selectively adjustable so as to apply a desired level of resistance to the rotation of the flywheel 120. Various types of braking mechanism 124 may be used including, in one embodiment, straps or pads that apply friction to the flywheel 120. In one embodiment, a magnetic brake (sometimes referred to as an eddy current brake) may be used to provide and adjustable level of resistance applied to the flywheel 120.

When the braking mechanism 124 is configured as a magnetic mechanism it may include an arm 126 that is pivotally coupled with the tower 104 and which contains a plurality of magnets arranged to provide a desired magnetic flux. As the arm 126 is rotated relative to tower 104 (and, thus, the flywheel 120), the magnetic flux through which the flywheel 120 rotates changes, thereby altering the amount of rotational resistance experienced by the flywheel 120.

The flywheel 120, when configured to interact with a magnetic braking mechanism, may include ferrous components, non-ferrous components, or both. In one embodiment, the flywheel 120 may include a relatively dense ferrous component to impart a desired level of rotational inertia to the flywheel. The flywheel 120 may also include a non-ferrous component to provide increased braking resistance when used with a magnetic brake mechanism. For example, one embodiment may include a portion that is formed of cast iron (a ferrous material) to provide the desired rotational inertia with another portion formed of an aluminum material (to provide increased braking response to the magnetic mechanism). One such configuration of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

A torque sensor 128 may be associated with the shaft 122 to determine the amount of torque applied to the flywheel by a drive mechanism (discussed below). Various types of torque sensors may be utilized. One example of a torque sensor includes that which is described in U.S. Pat. No. 7,011,326 to Schroeder et al., the disclosure of which is incorporated by reference herein in its entirety. Another example of a torque sensor includes that which is described in U.S. Pat. No. 7,584,673 to Shimizu, the disclosure of which is incorporated by reference herein in its entirety.

The apparatus further includes a control panel 130 which may be located adjacent the bearing 110 or some other convenient location (e.g., on the tower 104). The control panel 130 may include various input devices 132 (e.g., buttons, switches or dials) and output devices 134 (e.g., LED lights, displays, alarms) to provide means of interaction with a user of the apparatus 100. The control panel may further include connections for communication with other devices. The controller may include a processor and memory to provide various functions in controlling components of the apparatus 100 (e.g., the braking mechanism), in communicating with various components (e.g., the torque sensor) and making certain calculations as will be discussed below.

In one example, an input device 132 of the control panel 130 may be used to set a desired resistance level that is to be applied to the flywheel 120 by controlling an actuating member associated with the braking mechanism 124. An output device 134 (e.g., a display) may indicate the current or selected level of resistance. An output device 134 of the control panel 130 may also provide an indication of the amount of work performed within a period of time calculated, for example, based on the torque applied to the flywheel 120 as measured by the torque sensor 128.

Figure 4A:
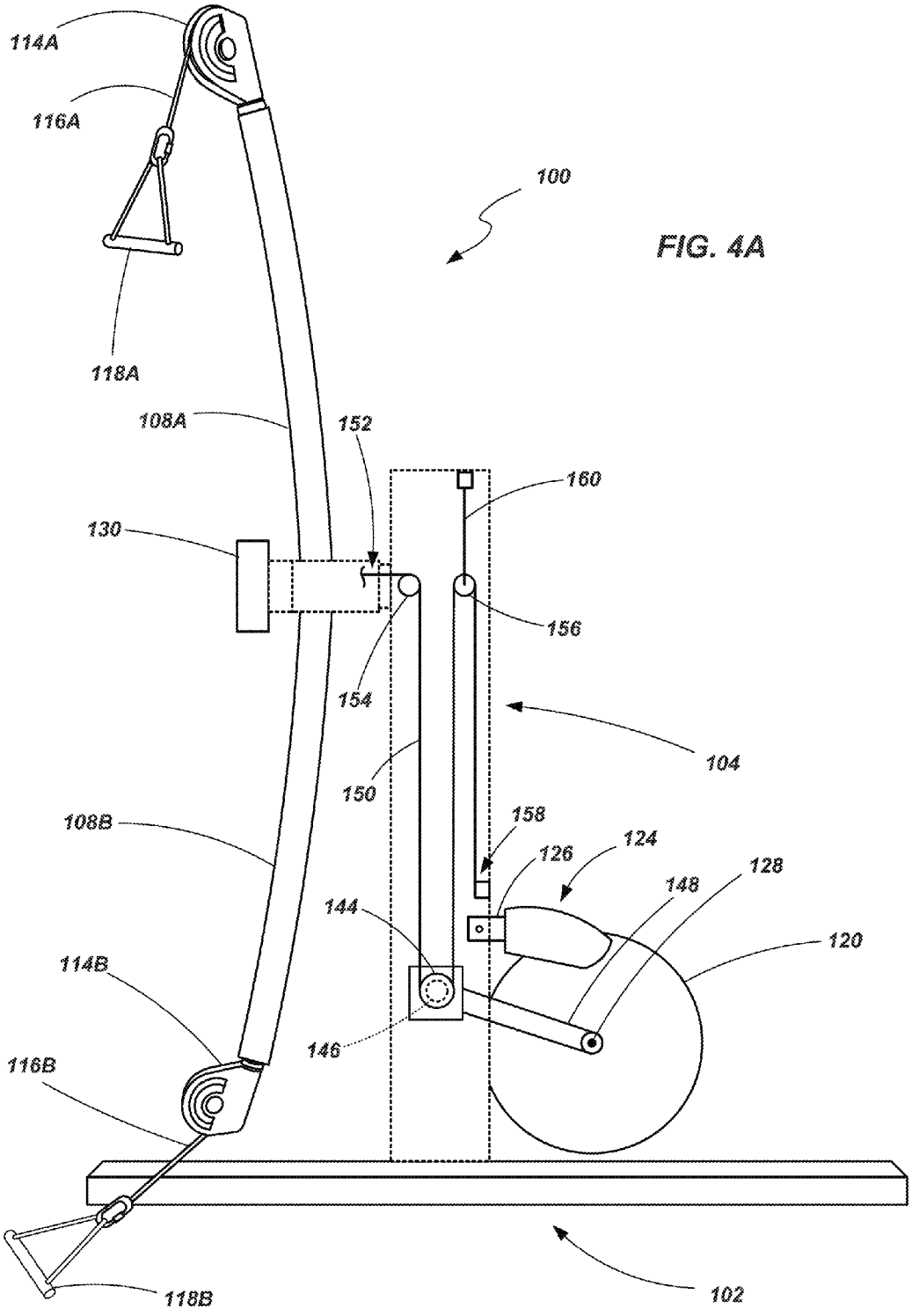
FIGS. 4A and 4B show a side view and a rear view, respectively, of the apparatus shown in FIG. 1, including various components, when the apparatus is in a first state.
Figure 4B:
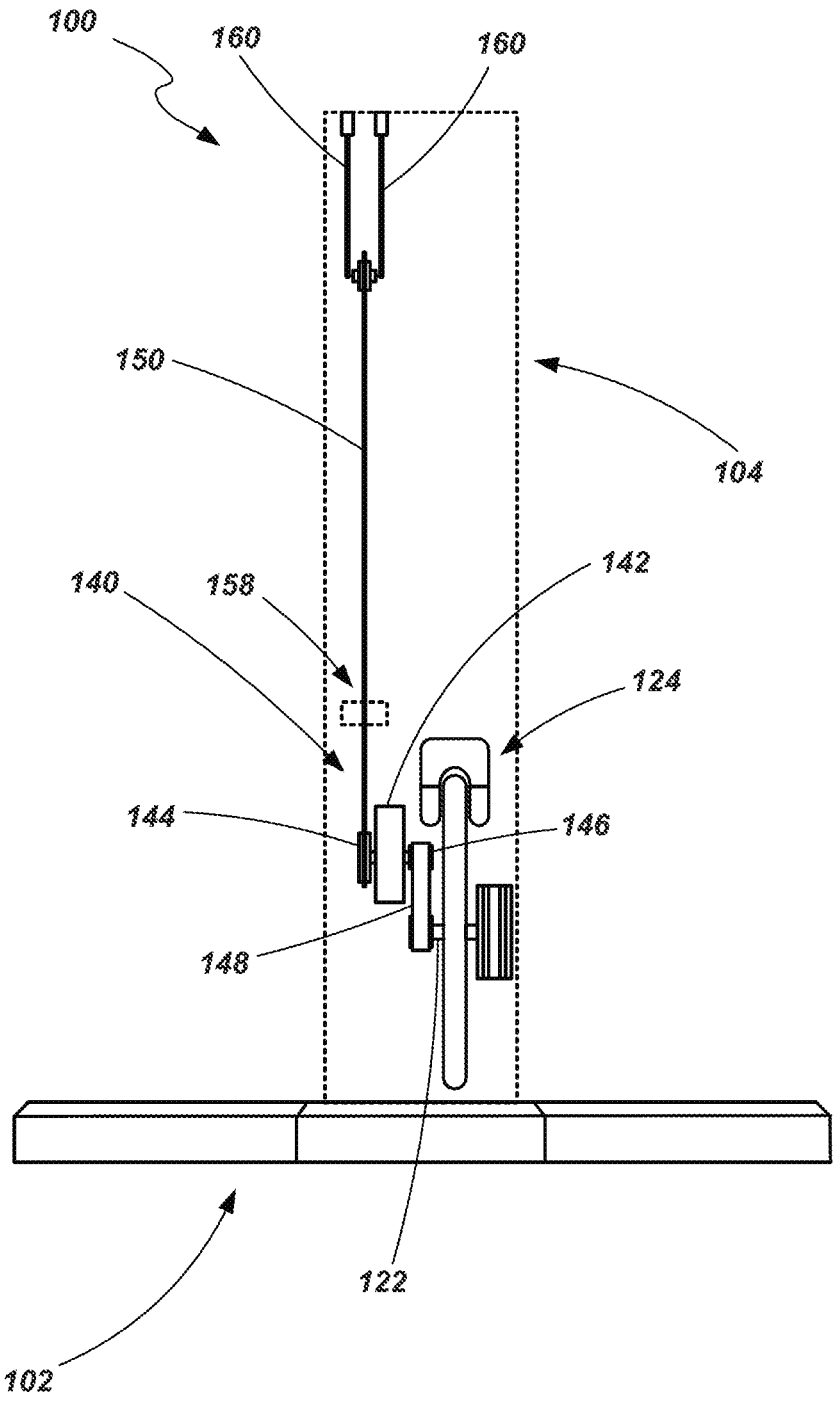

Referring now to FIGS. 4A and 4B, a side view and a rear view of the apparatus 100 is shown with various components which may be disposed within the tower 104 or otherwise arranged to assist in driving flywheel 120. It is noted that FIG. 4B does not depict the arms 108A and 108B (and associated components) for purposes of clarity and convenience. A drive mechanism 140 may include a clutch 142 having an input shaft 144 and an output shaft 146. A drive belt 148 (or drive chain or other similar drive structure) may extend about the output shaft 146 and also about the shaft 122 of the flywheel 120 (or associated pulleys coupled with the shafts). The clutch is configured such that, when the input shaft 144 is rotated in a first specified direction, the output shaft 146 is likewise rotated in a specified direction displacing the drive belt 148 and, ultimately, driving the flywheel 120 in a desired direction. However, if the input shaft 144 is rotated in a second direction, opposite that of the first direction, it has no effect on the output shaft 146. Rather, the output shaft is enabled to continue rotating in its initially specified direction and does not reverse directions. It is noted that, in other embodiments, the clutch 142 may be coupled directly to the flywheel 120.

A drive chain 150 (or drive belt or cable or other appropriate structure) has a first end 152 that is coupled to the cables 116A and 116B that extend through pulleys 114A and 114B and either extend through, or adjacent to, the arms 108A and 108B. The drive chain 150 extends through several pulleys or sprockets including, for example, a first sprocket 154, the input shaft 144 (or an associated pulley or sprocket coupled therewith) and a second sprocket 156. A second end 158 of the drive chain 150 may be fixed, for example, to a frame or other component associated with the tower 104. In the embodiment shown in FIGS. 4A and 4B, the first sprocket 154 is rotatable about an axis which is fixed relative to the tower 104. The second sprocket 156 is rotatable about an axis which is displaceable relative to the tower 104. For example, one or more biasing members 160 may be coupled between the second sprocket 156 and the tower 104 (or some component thereof) enabling the sprocket 156 to be displaced relative to the tower 104. Guide members may be used to help constrain or control the displacement of the sprocket along a desired path.

Figure 5A:
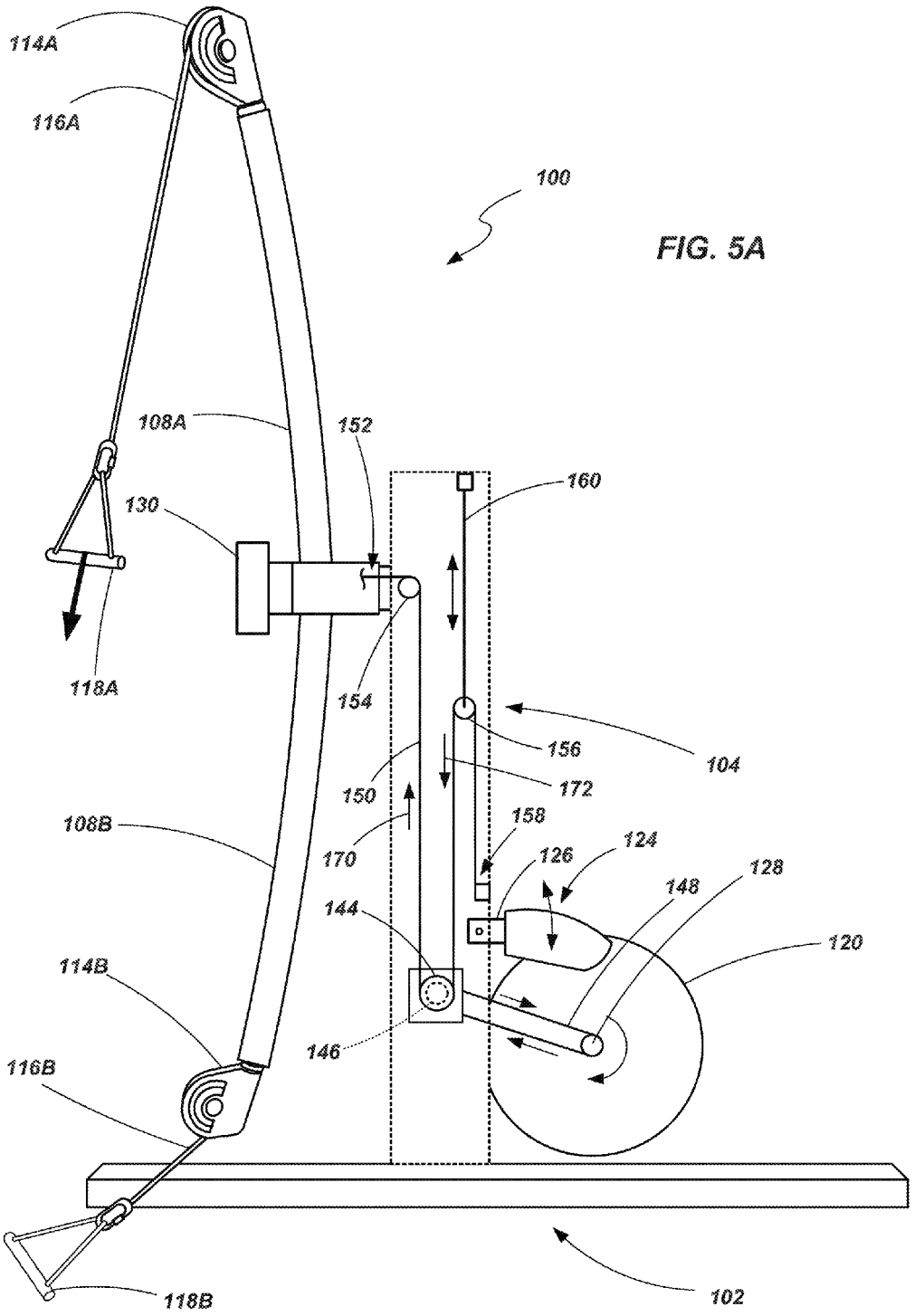
FIGS. 5A and 5B show a side view and a rear view, respectively, of the apparatus shown in FIG. 1, including various components, when the apparatus is in a second state.
Figure 5B:
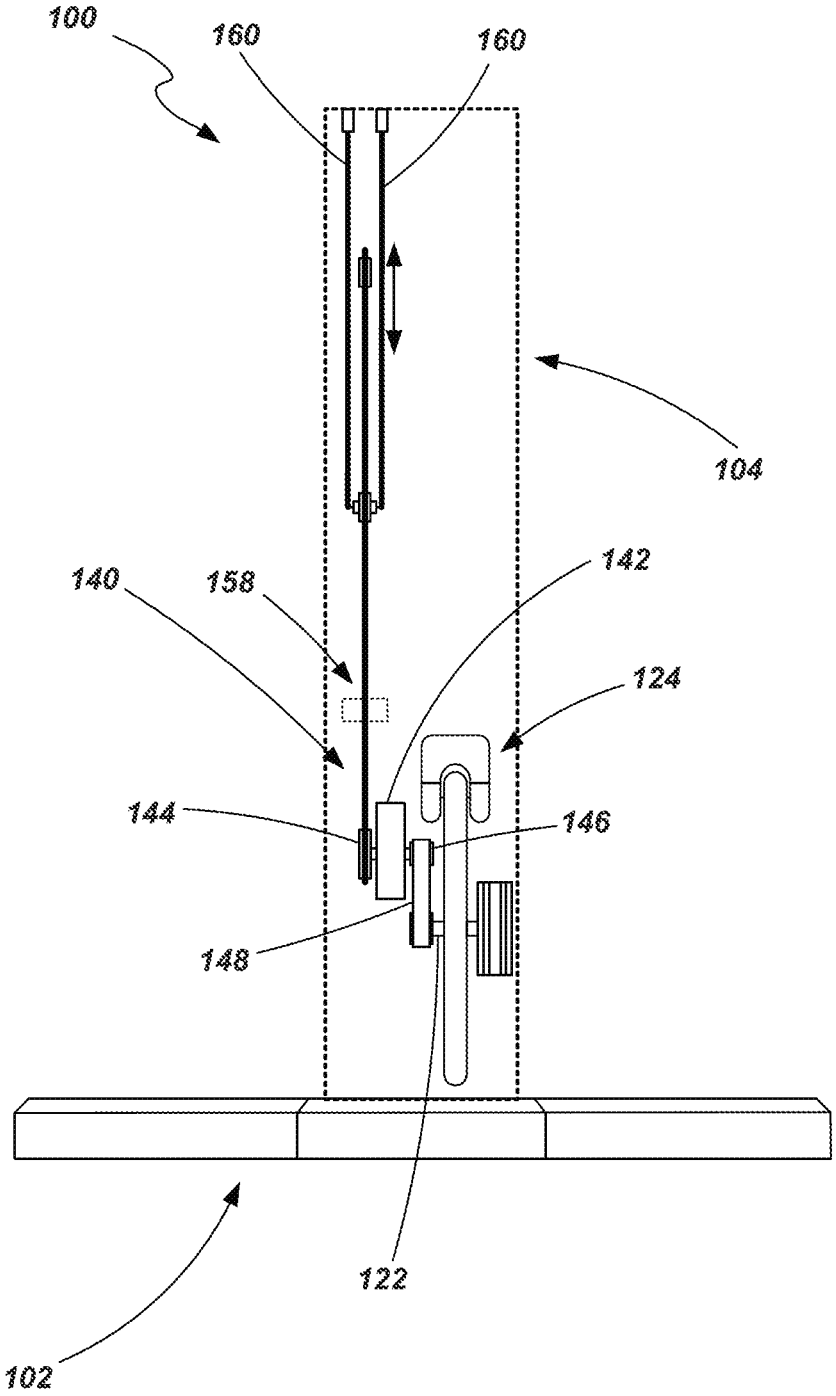

Referring briefly to FIGS. 5A and 5B, views similar to those depicted in FIGS. 4A and 4B, respectively, show certain components in a second position or state. Specifically, FIG. 5A depicts the displacement of a handle 118A due to application of a force by an individual during exercise. Displacement of the handle 118A results in displacement of the associated cable 116A and, ultimately, displacement of the drive chain 150. As indicated in FIG. 5A, a first portion of the drive chain 150 is displaced upwards towards the first sprocket 154 as indicated by directional arrow 170 while a second portion of the drive chain 150 is displaced downwards away from the second sprocket 156 and towards the input shaft 144 as indicated by directional arrow 172. It is noted that this displacement of the drive chain also includes the downward displacement of the second sprocket 156 against the force of the biasing members 160 as seen in both FIGS. 5A and 5B. The displacement of the drive chain 150 results in the rotation of the input shaft 144, actuating the drive mechanism 140 such that the drive belt 148 drives the flywheel 120.

Upon release of the force applied to the handle 118A, the biasing members 160 pull the second sprocket 156 back to its previous position bringing the various components (e.g., drive chain 150, cable 116A and handle 118A) back the positions shown in FIGS. 4A and 4B. However, as noted above, the return of the drive chain 150 to its previously position does not cause the flywheel 120 to rotate in the opposite direction or otherwise hinder its continued rotation due to the directional preference of the clutch mechanism 142. It is noted that, while the example shown in FIGS. 5A and 5B is described in terms of one particular handle (i.e., 118A) being displaced, the same functionality applies to the displacement to the other handle (i.e., 118B) or to both of them being substantially simultaneously displaced.

INDUSTRIAL APPLICABILITY

During exercise, many individuals desire to focus on anaerobic strength training, or to integrate anaerobic strength training with aerobic work-outs. One of the difficulties in mixing both aerobic and anaerobic activities is the ability of an individual to efficiently and effectively track their progress. For example, many individuals use aerobic exercise equipment such as a treadmill, an elliptical machine or a pedometer to help track the calories that they've burned while using such equipment. However, it is more difficult to track or calculate such information when doing strength training type of exercises.

The exercise apparatus provided herein provides a strength training apparatus that enables a variety of exercises while also providing the ability to track the work performed by an individual during their exercise session. By positioning the adjustable arms at different locations relative to the tower, different types of exercises may be conducted. For example, due to the adjustability of the arms/pulleys, the exercise apparatus may be used to perform exercises including, but not limited to, standing abdominal crunches, curls and other bicep exercises, lat pull-downs, chest presses, incline and decline presses, overhead presses, triceps extensions, shoulder extensions, leg extensions, leg curls, abduction and adduction exercises, and a variety of other exercises, including variations of the examples provided.

Additionally, the use of a flywheel in connection with a strength training apparatus provides a different form of resistance than in conventional strength training exercises, one that can be measured, tracked and incorporated into a planned exercise routine. The flywheel, combined with a braking mechanism such as a magnetic brake, enables considerable flexibility in setting the desired resistance during exercise. In many conventional strength training exercises, the amount of resistance provided (e.g., by free weights, weight stacks or resistance bands) is only adjustable in set increments (e.g., 5 or 10 pound increments). The use of a flywheel with a variable resistance braking mechanism enables fine tuning of the resistance over a continuous spectrum between two defined limits.

The use of a torque sensor in conjunction with the flywheel enables the calculation of work, power or energy so that, for example, a user of the apparatus may determine their performance level while using the exercise apparatus. In one particular example, the power expended during an exercise session may be expressed in watts (i.e., joules/sec (J/s) or newton meters/sec (N*m/s). A user of the machine can review the power expended during an exercise session from a display (or other output device) associated with the exercise apparatus and then compare their performance to a goal or a benchmark.

Such a way of tracking the effort expended during an anaerobic exercise routine provides more insight into the progress of the individual than just the number of repetitions completed during a given work-out session. If desired, other units may be utilized to track the energy expended by an individual during a work-out session. For example, rather than expressing the work-out performance in terms of watts (units of power), it could be expressed in terms of joules (units of work).

This information could be used with information from other work-out activities, including aerobic exercise, to consistently monitor the performance of an individual over a desired period of time. For example, rather than expressing the performance of an individual on a treadmill or an elliptical machine in terms of calories, those performances may similarly be provided in terms of watts (or another selected unit) so that all types of exercise activity may be monitored uniformly. An individual may then customize their exercise routine based, for example, on the amount of work that is to be performed regardless of whether that work occurs during an aerobic or an anaerobic activity.

One example of customizing a work-out that may be utilized in conjunction with the exercise apparatus described herein is set forth in U.S. patent application Ser. No. 13/754,361, filed on Jan. 30, 2013, the disclosure of which is incorporated by reference herein in its entirety. One particular example of tracking a work-out across various exercise equipment and which may be utilized in conjunction with the exercise apparatus described herein is set forth in U.S. Pat. No. 6,746,371 to Brown et al., the disclosure of which is incorporated by reference herein in its entirety.

What is claimed is:

1. A strength training apparatus comprising:

a base member;

a tower structure coupled with the base member;

at least one arm pivotally coupled with the tower structure;

a flywheel; and a cable and pulley system associated with the at least one arm, wherein displacement of at least one cable of the cable and pulley system effects rotation of the flywheel;

wherein the at least one arm includes a pair of arms and wherein the cable and pulley system includes a first pulley coupled with a first arm of the pair of arms with a first cable extending through the first pulley and a second pulley coupled with the second arm with a second cable extending through the second pulley.

2. The apparatus of claim 1, further comprising a braking mechanism associated with the flywheel and configured to apply a selected resistance to the rotation of the flywheel.

3. The apparatus of claim 2, wherein the braking mechanism includes a magnetic braking mechanism.

4. The apparatus of claim 3, further comprising a torque sensor associated with the flywheel.

5. The apparatus of claim 4, further comprising a console having at least one input device and at least one output device.

6. The apparatus of claim 5, wherein the console is in communication with the braking mechanism and wherein the at least one input device controls the amount of resistance applied to the flywheel by the braking mechanism.

7. The apparatus of claim 6, wherein the console is in communication with the torque sensor and wherein the at least one output device provides an indication of the amount of work expended by a user upon rotation of the flywheel.

8. The apparatus of claim 7, wherein the at least one output device provides the indication of the amount of work expended in units of watts.

9. The apparatus of claim 4, further comprising a drive mechanism associated with the flywheel.

10. The apparatus of claim 9, wherein the drive mechanism includes a clutch mechanism coupled with the flywheel by way of a drive belt.

11. The apparatus of claim 10, wherein the clutch mechanism enables the rotation of the flywheel in a first rotational direction upon the displacement of the at least one cable in a first defined direction, but has no effect on the flywheel upon displacement of the at least one cable in a second defined direction, the second defined direction being the opposite of the first defined direction.

12. The apparatus of claim 10, wherein the drive mechanism includes a drive chain coupled with the cable and pulley system, wherein the drive chain extends about a plurality of sprockets including at least one sprocket that is displaceable relative to the tower.

13. The apparatus of claim 12, further comprising at least one biasing member coupled with the at least one displaceable sprocket.

14. The apparatus of claim 9, wherein the pair of arms are maintained in a fixed angular position relative to each other.

15. A strength training apparatus comprising:

a base member;

a tower structure coupled with the base member;

a pair of arms pivotally coupled with the tower structure;

a flywheel configured to rotate about a defined axis;

a cable and pulley system including a first pulley coupled with a first arm of the pair of arms with a first cable extending through the first pulley and a second pulley coupled with the second arm with a second cable extending through the second pulley, wherein displacement of at least one cable of first cable and the second cable effects rotation of the flywheel;

a magnetic braking mechanism associated with the flywheel and configured to apply a selected resistance to the rotation of the flywheel;

a torque sensor associated with the flywheel;

a console in communication with the braking mechanism and the torques sensor, the console including at least one input for selecting the amount of resistance applied to the flywheel by the braking mechanism and at least one output device providing an indication of the amount of work expended by a user upon rotation of the flywheel, the amount of work being displayed in units of watts; and a drive mechanism associated with the flywheel including a clutch mechanism coupled with the flywheel by way of a drive belt.

16. A method of conducting strength training, the method comprising:

providing a strength training apparatus, wherein the strength training apparatus includes a base member, a tower structure coupled with the base member, a pair of arms pivotally coupled with the tower structure, a flywheel, and a cable and pulley system including a first pulley coupled with a first arm of the pair of arms with a first cable extending through the first pulley and a second pulley coupled with the second arm with a second cable extending through the second pulley, wherein displacement of at least one cable of the cable and pulley system effects rotation of the flywheel;

applying a force to the cable and displacing the cable in a first direction;

effecting rotation of the flywheel upon displacement of the cable;

applying a resistance to the flywheel;

measuring the torque applied to the flywheel; and calculating the work performed, in watts, based at least in part on the measured torque.

17. The method according to claim 16, wherein applying resistance to the flywheel includes applying resistance using a magnetic brake.

18. The method according to claim 17, further comprising selectively varying the resistance applied by the magnetic brake.

* * * * *